US009919776B2

(12) United States Patent
Greenan et al.

(10) Patent No.: US 9,919,776 B2
(45) **Date of Patent: *Mar. 20, 2018**

(54) PERSONAL FLOTATION APPARATUS

(71) Applicants: Thomas Greenan, Leander, TX (US); Manda Northcutt, Leander, TX (US)

(72) Inventors: Thomas Greenan, Leander, TX (US); Manda Northcutt, Leander, TX (US)

(73) Assignees: Thomas Greenan, Leander, TX (US); Manda Northcutt, Leander, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/203,473

(22) Filed: Jul. 6, 2016

(65) Prior Publication Data

US 2016/0311507 A1 Oct. 27, 2016

Related U.S. Application Data

(63) Continuation of application No. 14/789,765, filed on Jul. 1, 2015, now Pat. No. 9,403,583, and a continuation-in-part of application No. 13/688,361, filed on Nov. 29, 2012, now abandoned.

(60) Provisional application No. 61/564,499, filed on Nov. 29, 2011.

(51) Int. Cl.

| | |
|---|---|
| ***B63C 9/08*** | (2006.01) |
| ***A63B 69/14*** | (2006.01) |
| ***A63B 31/00*** | (2006.01) |
| ***B63B 35/73*** | (2006.01) |

(52) U.S. Cl.
CPC ..... *B63B 35/73* (2013.01); *A63B 31/00* (2013.01); *A63B 69/14* (2013.01); *B63C 9/08* (2013.01); *A63B 2225/605* (2013.01)

(58) Field of Classification Search
CPC ..... B63C 9/08; B63B 35/73; A63B 31/00; A63B 69/14; A63B 2225/605
USPC ..... 441/88, 129; 446/124, 126
See application file for complete search history.

(56) References Cited

U.S. PATENT DOCUMENTS

| | | | | |
|---|---|---|---|---|
| 5,897,409 A * | 4/1999 | Hartman | A47C 15/006 | 441/129 |
| 7,040,949 B2 * | 5/2006 | Slocum | A63H 33/065 | 446/122 |
| 2009/0156086 A1 * | 6/2009 | Hartings | A63H 23/005 | 446/124 |
| 2011/0183557 A1 * | 7/2011 | Edmonds | B63B 35/73 | 441/129 |

* cited by examiner

*Primary Examiner* — Anthony D Wiest
(74) *Attorney, Agent, or Firm* — Hunt Pennington Kumar & Dula, PLLC; Jeffrey D. Hunt; Austin Dula

(57) ABSTRACT

A personal flotation apparatus having a main body member, a primary support member, a head support member, and a foot support member, each made of flexible, buoyant, flotation material. The primary support member, head support member, and foot support member are each connected to the main body member, such that they are substantially perpendicular to the main body member and can provide stability, buoyancy and support in various floating and swimming positions. Some embodiments include multiple main body members to increase stability, buoyancy, support and comfort, and allow for heavier users.

18 Claims, 27 Drawing Sheets

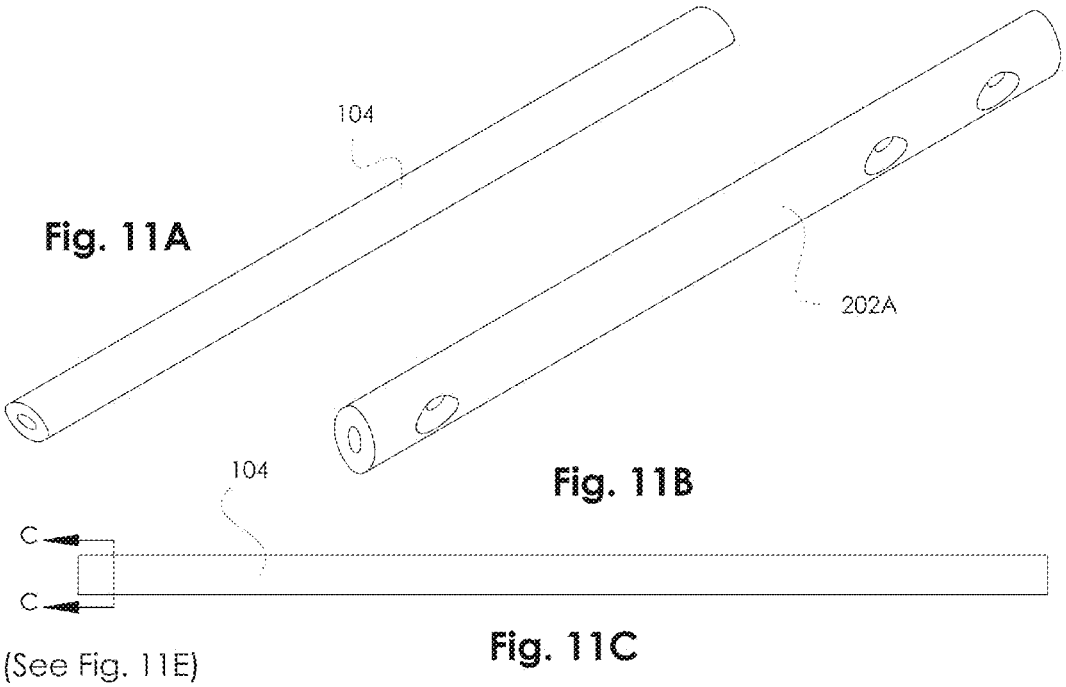
Fig. 11A
Fig. 11B
Fig. 11C
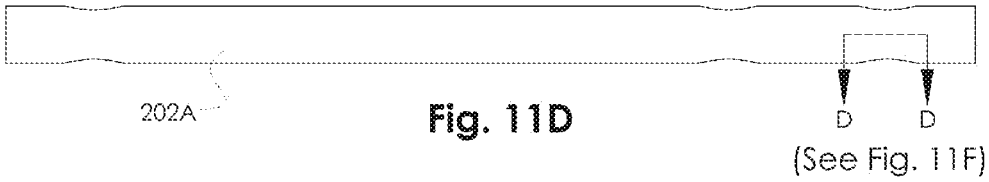
Fig. 11D
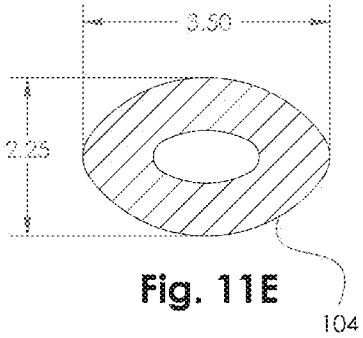
Fig. 11E
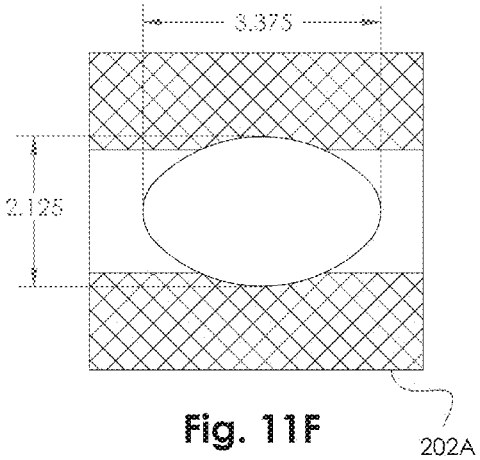
Fig. 11F

PERSONAL FLOTATION APPARATUS

CROSS-REFERENCE TO RELATED APPLICATIONS

This application claims priority to the U.S. Non-Provisional patent application Ser. No. 14/789,765 filed on Jul. 1, 2015, which claims priority to U.S. Provisional Patent Application Ser. No. 61/564,499, entitled "PERSONAL FLOTATION APPARATUS" and filed on Nov. 29, 2011 and are all herein incorporated by reference in their entirety.

This application claims priority to U.S. Utility application Ser. No. 13/688,361, filed Nov. 29, 2012.

FIELD OF THE INVENTION

The disclosed subject matter relates to personal flotation devices.

BACKGROUND OF THE INVENTION

Personal flotation devices for use in pools, lakes, oceans and other bodies of water have been around for quite some time, and as a result they come in many forms. Naturally, various uses have developed over the years, including safety and rescue uses, physical exercise and training uses, competitive uses and recreational uses.

Personal flotation devices come in a range of sizes and materials as well as different forms. Some are made of a single piece of material, while others involve complicated structures. Many personal flotation devices involve pocket-like structures made of plastic or other material that is then inflated (e.g. inflatable raft).

In response to a desire for a personal flotation device that allows the user to be partially submerged while floating in a seated or lying position, many such devices have been created. Some devices involve a buoyant object or structure on which the user balances. Other devices use a net or other porous material connected to a buoyant object. Still others involve buoyant objects that are attached to the user with straps, belts, ties, snaps, buckles or otherwise.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

BRIEF SUMMARY OF THE INVENTION

The disclosed subject matter relates to a personal flotation apparatus.

A first aspect of the disclosed subject matter provides a main body member having a head support member connected at the main body member's upper end and a foot support member connected at the main body member's lower end and a primary support member connected somewhere along its length between the other two support members, the primary, head and foot support members and main body member consisting of a flexible, buoyant flotation material, wherein the various members of the personal flotation apparatus can be deformed to allow for different positions and uses.

In some embodiments of the disclosed subject matter the support members are connected to the main body member via a friction fit through holes cut into the main body member.

In other embodiments of the disclosed subject matter, the flotation apparatus comprises multiple main body members.

In yet other embodiments of the disclosed subject matter, the members of the personal flotation apparatus consist of a closed cell foam material.

In yet other embodiments of the disclosed subject matter, the members of the personal flotation apparatus consist of elliptic cylinders.

In some embodiment of the disclosed subject matter, the personal flotation apparatus may have a first configuration, comprising one or more members, wherein the one or more members are separable to form a greater number of members. In some embodiments, the members may have perforations, that when activated, allow the disassemble of the member into two or more component parts.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages that are included within this description, be within the scope of any claims filed later.

BRIEF DESCRIPTIONS OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

FIGS. 11A and 11C depict a perspective view and a top view, respectively, of a supporting main body member of an embodiment of the personal flotation apparatus.

FIGS. 11B and 11D depict a perspective view and a top view, respectively, of a main body member of an embodiment of the personal flotation apparatus.

FIG. 11E depicts a cross-sectional view of a supporting main body member of an embodiment of the personal flotation apparatus.

FIG. 11F depicts a cross-sectional view of a hole of the main body member of an embodiment of the personal flotation apparatus.

In the FIGURES, like elements should be understood to represent like elements, even though reference labels are omitted on some instances of a repeated element, for simplicity.

DETAILED DESCRIPTION OF ILLUSTRATIVE EMBODIMENTS

Figure 1A:
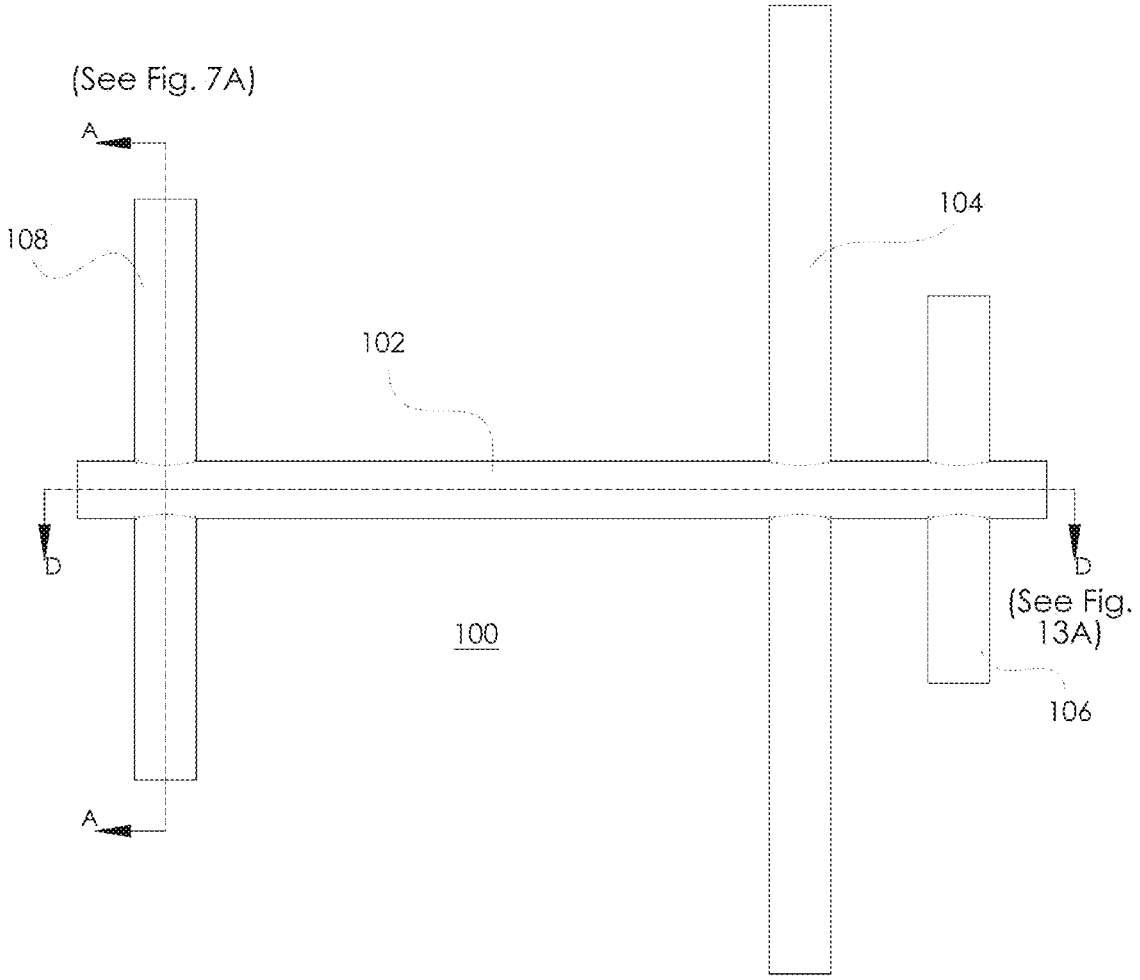
FIGS. 1A, 1B and 1C depict a top view, a perspective view, and a side view, respectively, of one embodiment of the personal flotation apparatus.
Figure 1B:
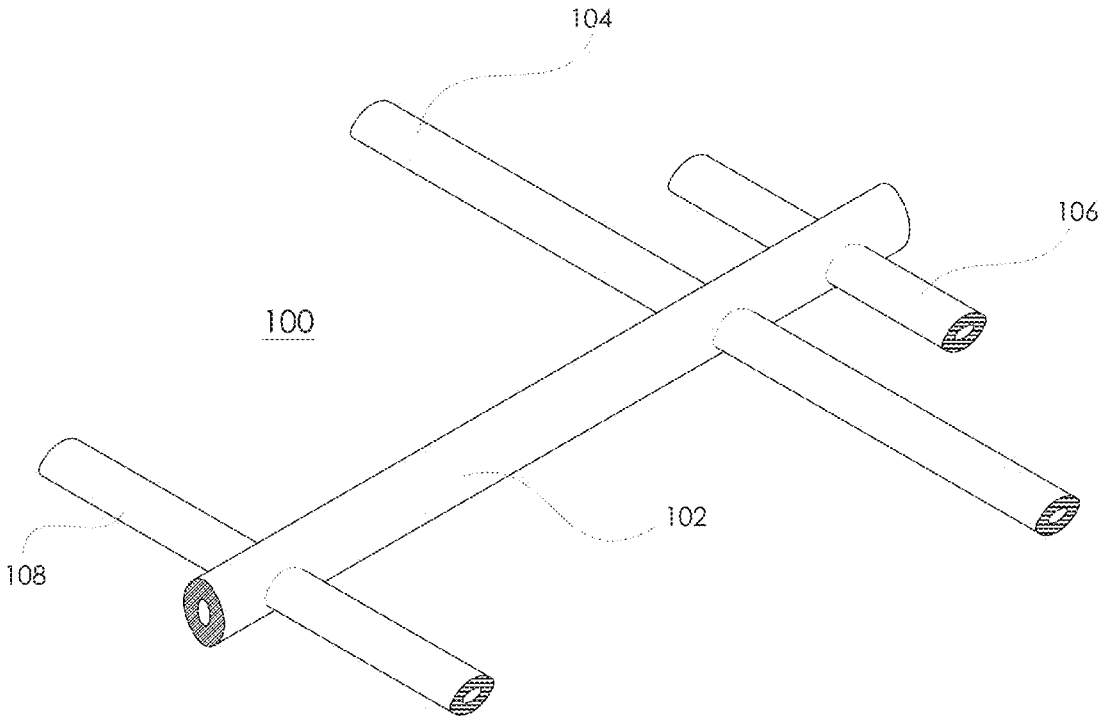
Figure 1C:
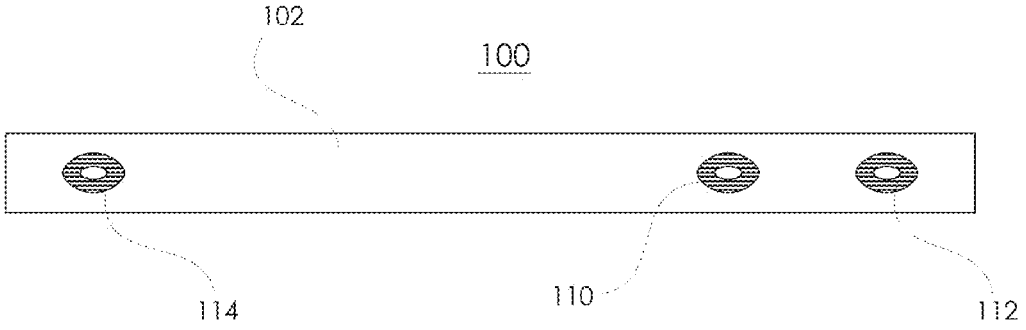

Reference now should be made to the drawings, in which the same reference numbers are used throughout the different figures to designate the same components. FIGS. 1A-1C depict a top view, a perspective view, and a side view, respectively, of one embodiment of the disclosed subject matter. An apparatus 100 generally comprises a main body member 102, a primary support member 104, a head support member 106, and a foot support member 108.

The primary support member 104, the head support member 106 and the foot support member 108, are each generally connected to the main body member 102, such that the support members 104, 106, 108 are substantially perpendicular to the main body member 102. For example, the primary support member 104, the head support member 106, and the foot support member 108 may be connected to the main body member 102 by a friction fit through a primary support hole 110, a head support hole 112, and a foot support hole 114, respectively, cut into the main body member 102. A friction fit, or interference fit, may be achieved by making the dimensions of the holes, 110, 112, 114 the same or smaller than the outer dimensions of the members 104, 106, 108 such that when forced to connect, the friction between them is significant enough to sustain the connection. While a friction fit is depicted in this embodiment to allow for disassembly and reassembly for ease of shipping, display and storage, other embodiments may use other permanent, nonpermanent, and/or adjustable means to connect any of the support members 104, 106, 108 to the main body member 102.

The primary support hole 110 may generally be located anywhere along the length of the main body member 102 to allow for different user heights. The head support hole 112 may generally be located further toward the upper end of the main body member 102 than the primary support hole 110, and the foot support hole 114 may generally be located further toward the lower end of the main body member 102 than the primary support hole 110. For example, in one embodiment the main body member 102 may be approximately 55 inches; measuring from a lower end of the main body member 102, the foot support hole 114 may be centered at approximately 7 inches, the primary support hole 110 may be centered at approximately 41 inches, and the head support hole 112 may be centered at approximately 50 inches, although other distances may be used.

Figure 2A:
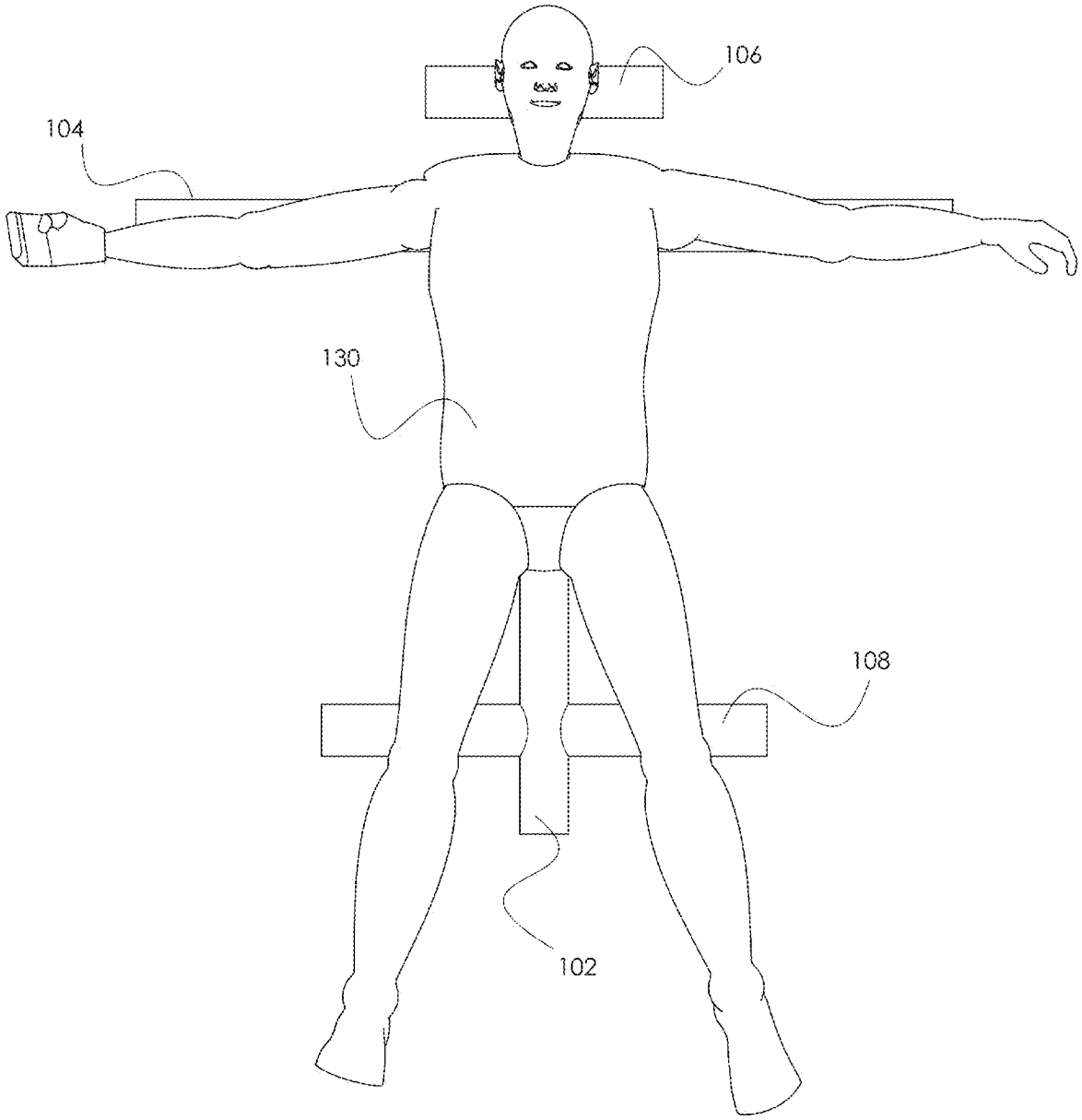
FIGS. 2A, 2B and 2C depict a top view, a perspective view, and a side view, respectively, of one embodiment of the personal flotation apparatus in use before being deformed.
Figure 2B:
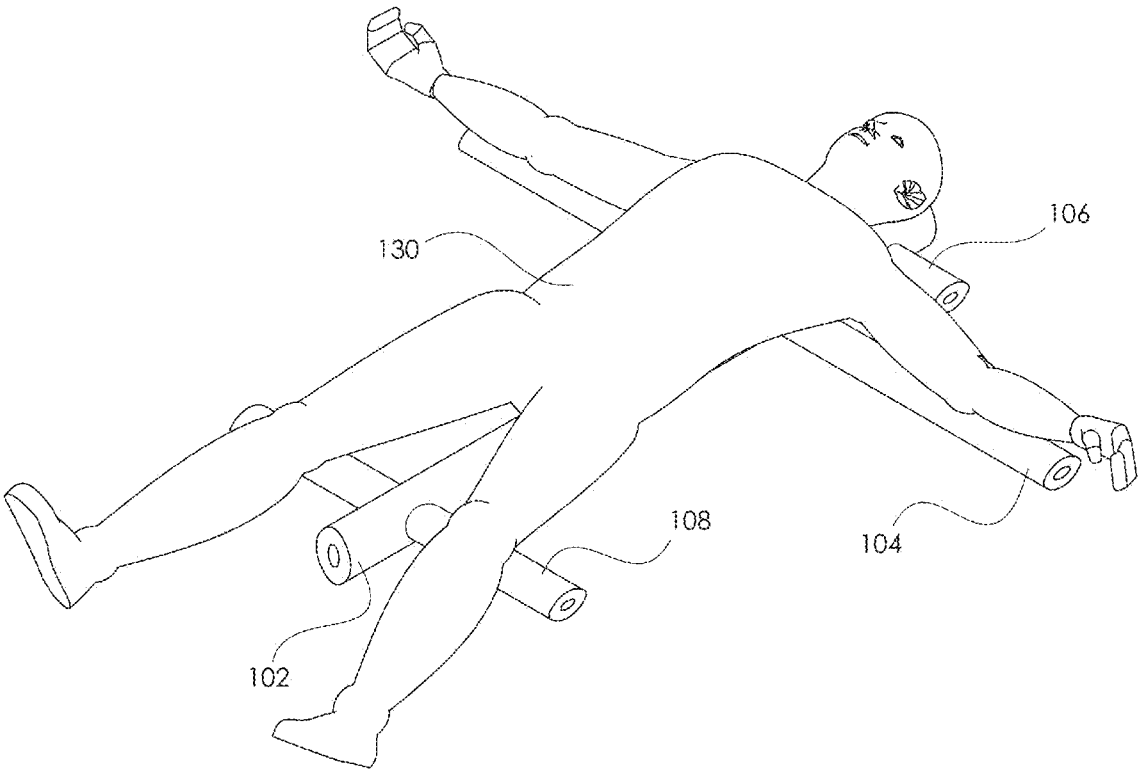
Figure 2C:
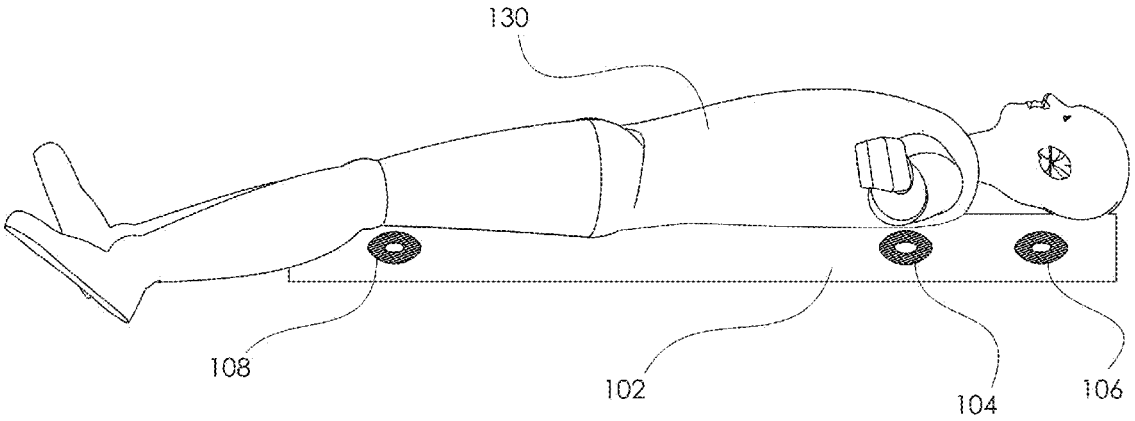

In FIGS. 2A-2C, a user 130 is shown lying flat on the apparatus 100 before it deforms. In some embodiments, when user 130 lies flat on the apparatus 100, the main body member 102 generally resides within the natural indention of the user's 130 spine. The primary support member 104 is generally long enough to help provide buoyancy and stability as well as support for the arms of user 130. For example, the primary support member 104 may be four to five feet long, although different embodiments may use other lengths. Head support member 106 and foot support member 108 are generally long enough to provide buoyancy and stability as well as support for the head and legs of user 130, respectively. For example, the head support member 106 may be one to two feet long, and the foot support member 108 may be two to three feet long, although other lengths may be used in different embodiments. Together the support of primary support member 104, head support member 106 and foot support member 108 allows user 130 to remain stably on top of the apparatus 100, such that if user 130 shifts to one side or the other of main body member 102, the user will not fall off of the apparatus 100 because the buoyancy of the support members 104, 106, 108 will maintain the balance of apparatus 100 and allow user 130 to maintain stably on top.

Figure 3A:
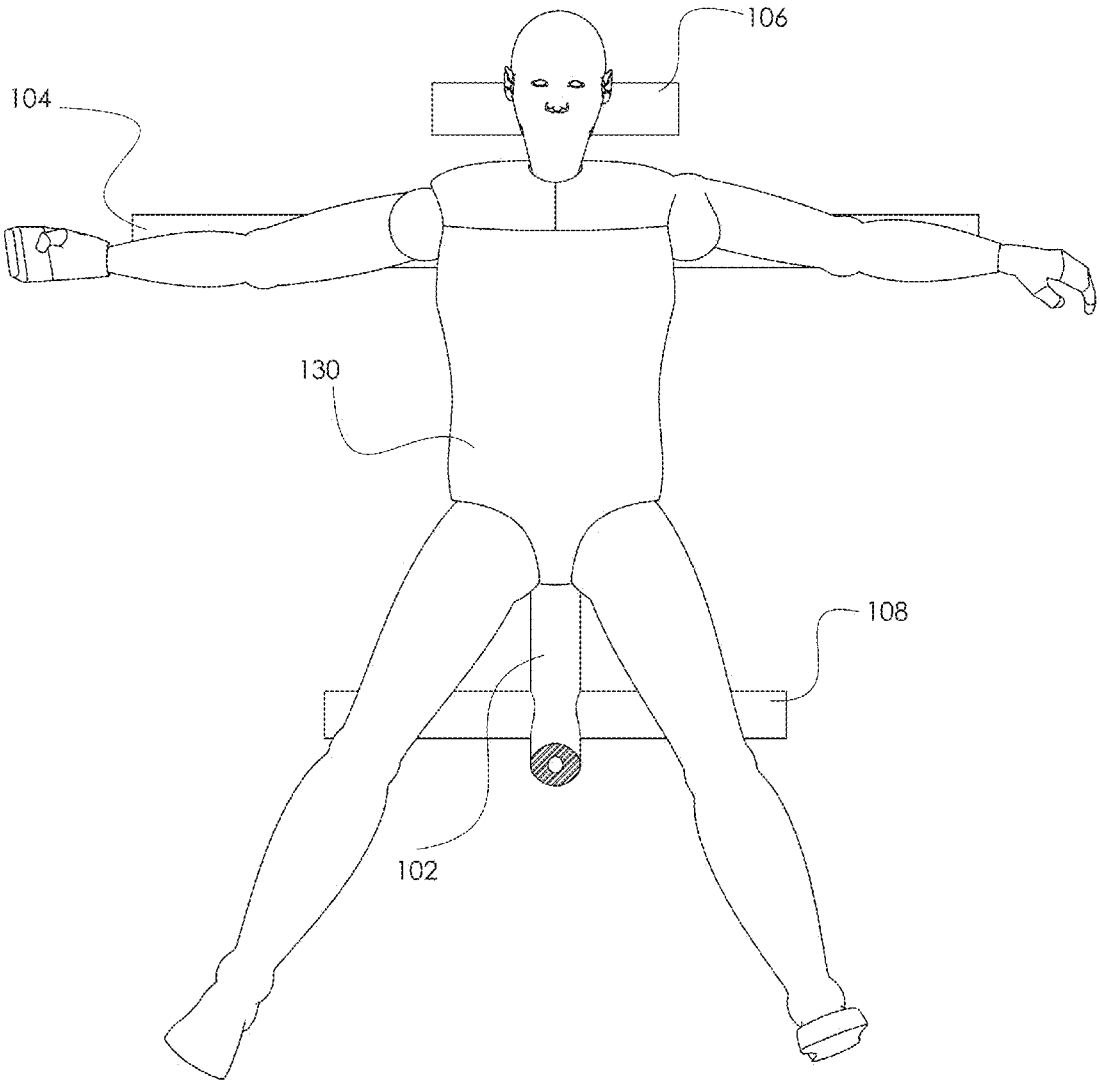
FIGS. 3A, 3B and 3C depict a top view, a perspective view, and a side view, respectively, of one embodiment of the personal flotation apparatus in use in a partially deformed state for lounging.
Figure 3B:
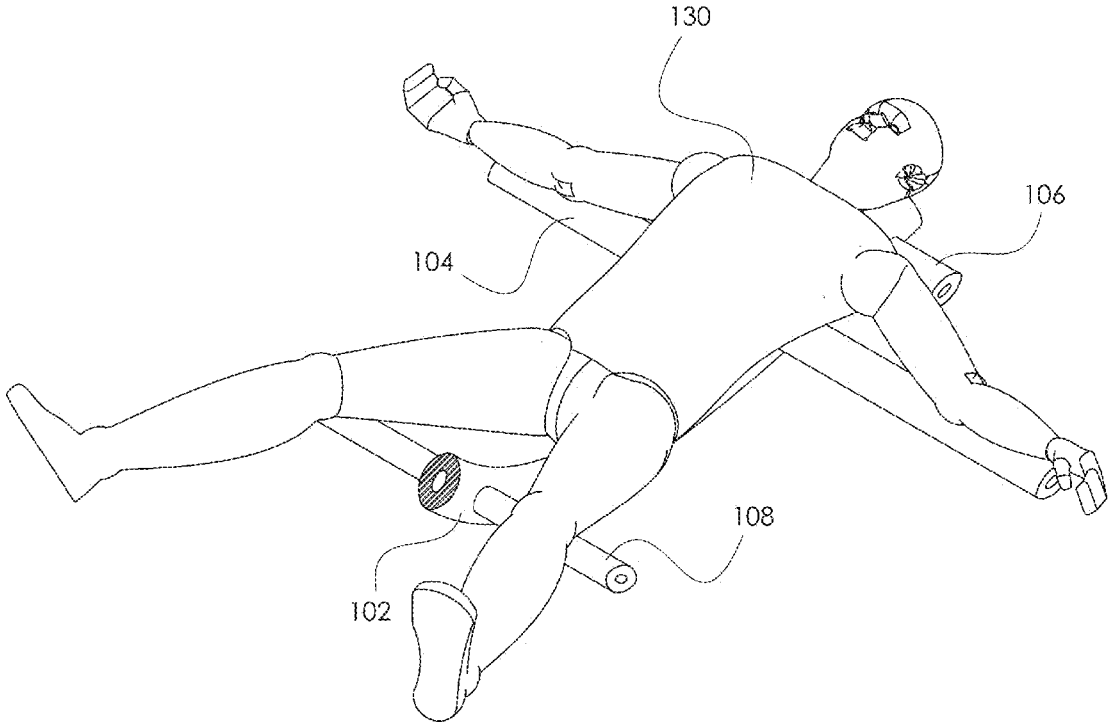
Figure 3C:
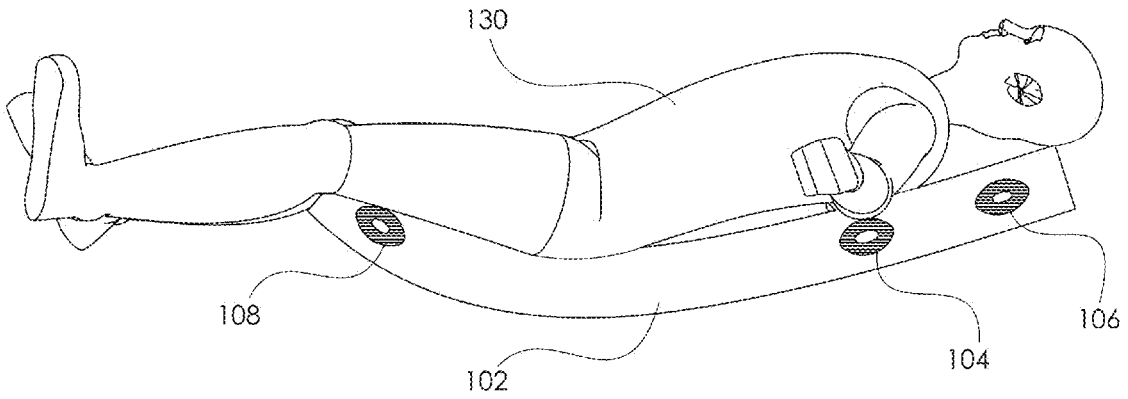

FIGS. 3A-3C depict the user 130 lounging on apparatus 100 after the main body member 102 has partially deformed due to the body weight and positioning of user 130. The partially deformed state of main body member 102 in combination with the support from primary support member 104, head support member 106 and foot support member 108 allow user 130 to comfortably float in a lounge position while remaining stably situated on the apparatus 100.

Figure 4A:
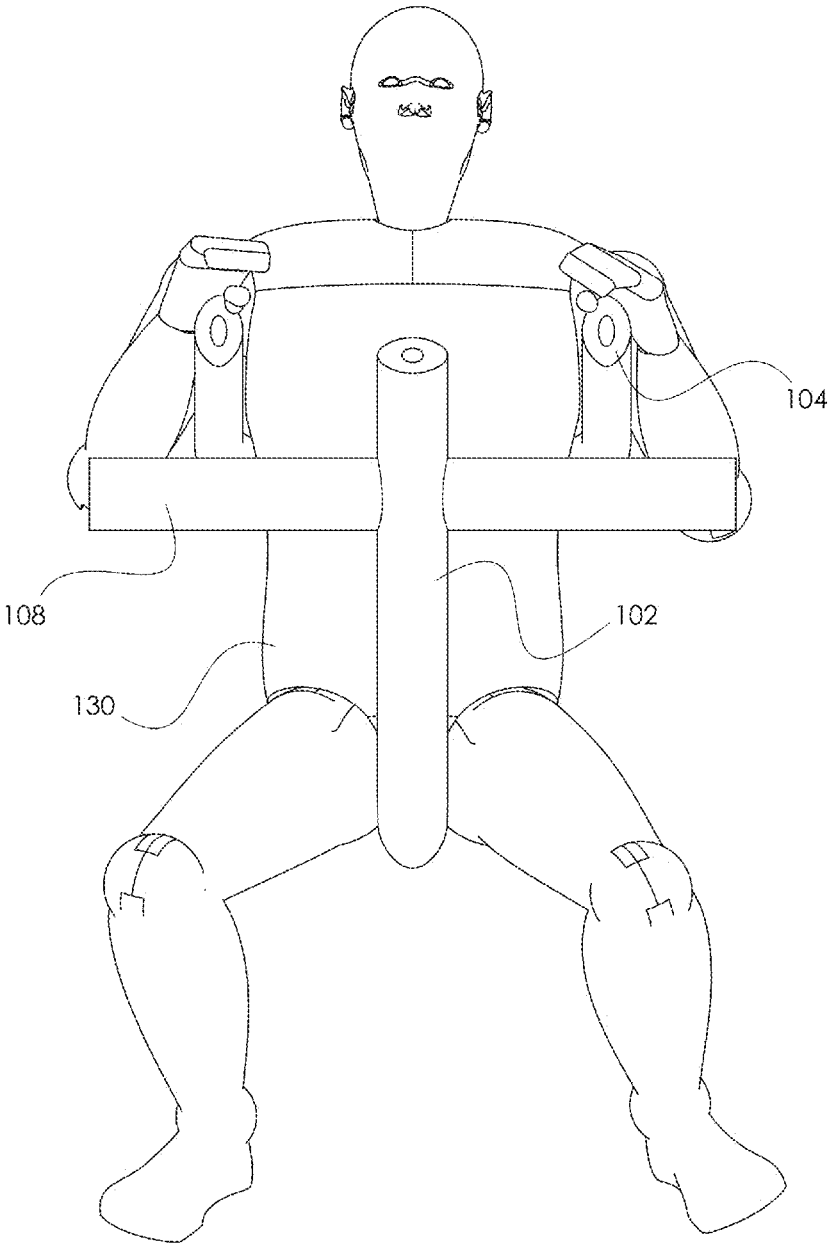
FIGS. 4A, 4B and 4C depict a front view, a perspective view, and a side view, respectively, of one embodiment of the personal flotation apparatus in use in a substantially deformed state for sitting.
Figure 4B:
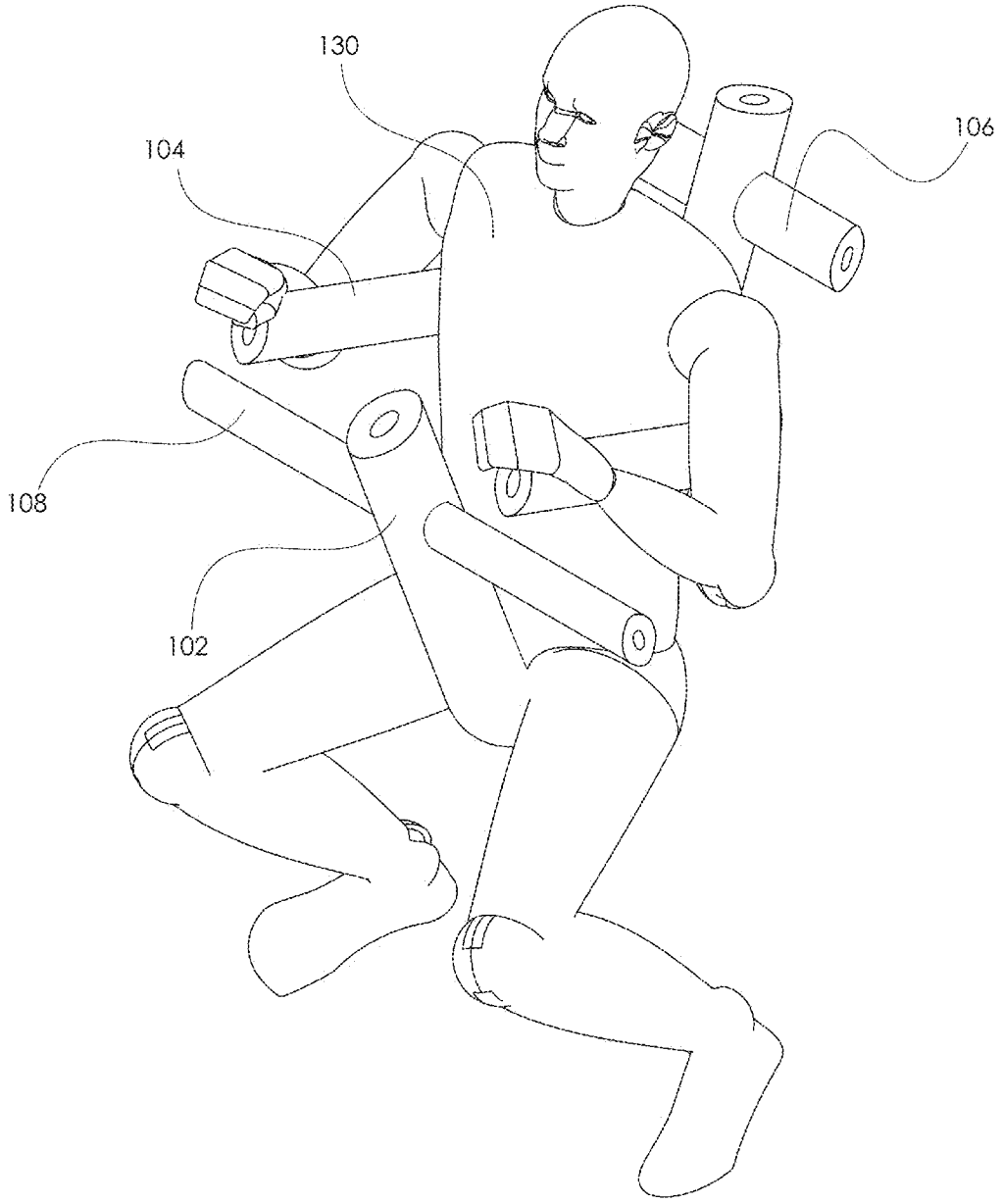
Figure 4C:
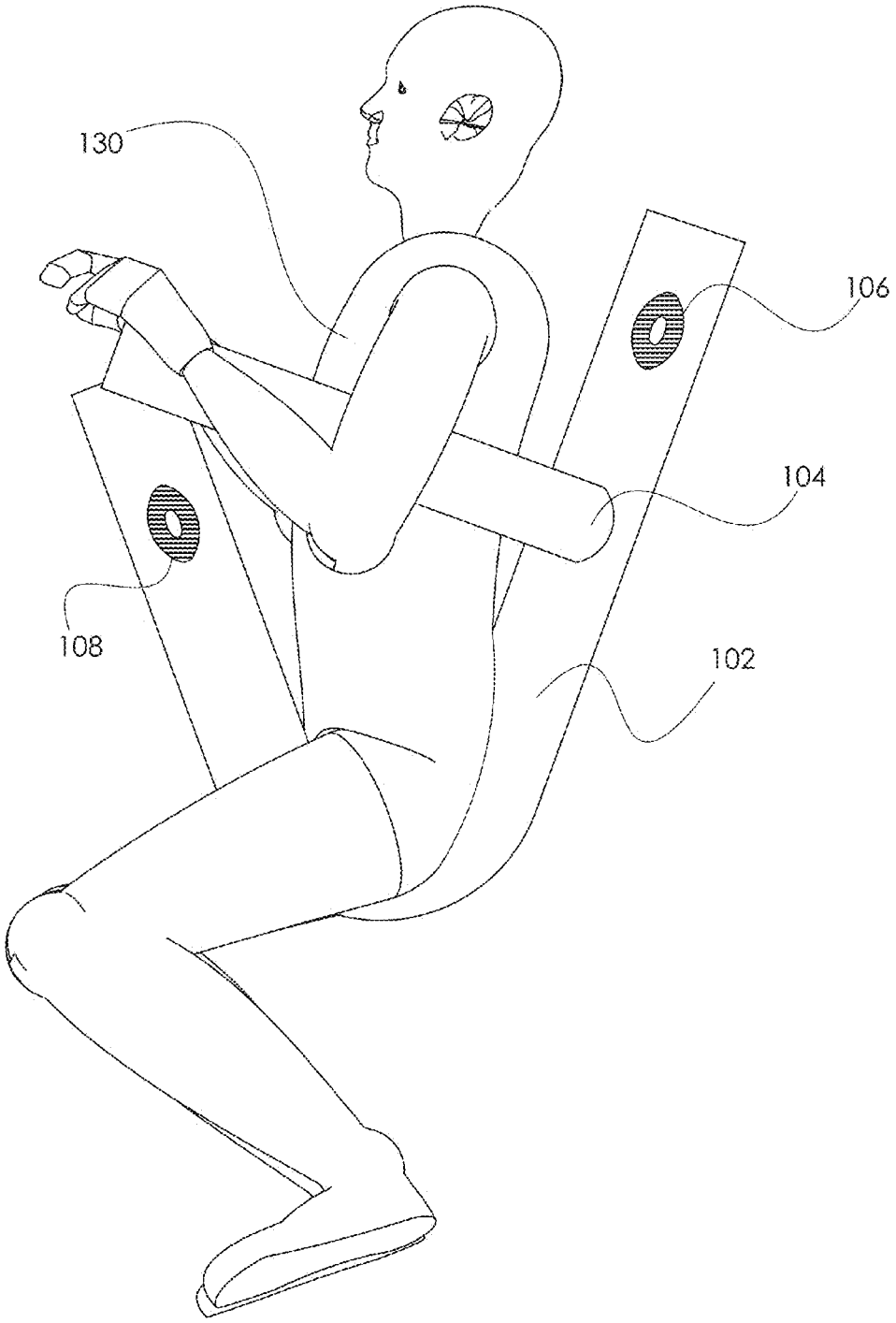

FIGS. 4A-4C show the main body member 102 and the primary support member 104 each in a substantially deformed state, allowing the user 130 to float comfortably in a sitting position on the apparatus 100. The primary support member 104 in the substantially deformed position provides stability for remaining on the apparatus 100 as well as support for the arms of user 130.

Figure 5A:
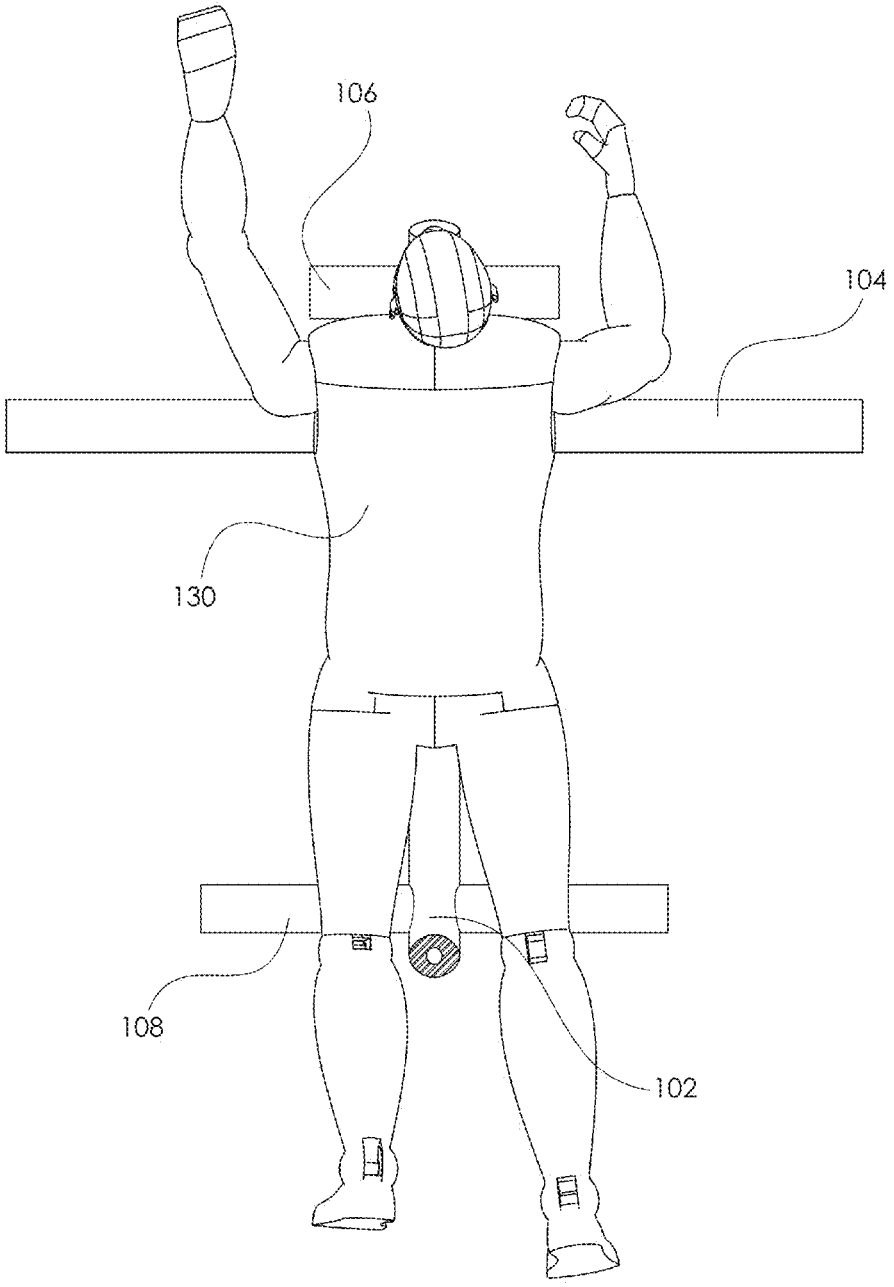
FIGS. 5A, 5B and 5C depict a top view, a perspective view, and a side view, respectively, of one embodiment of the personal flotation apparatus in use in a partially deformed state for swimming.
Figure 5B:
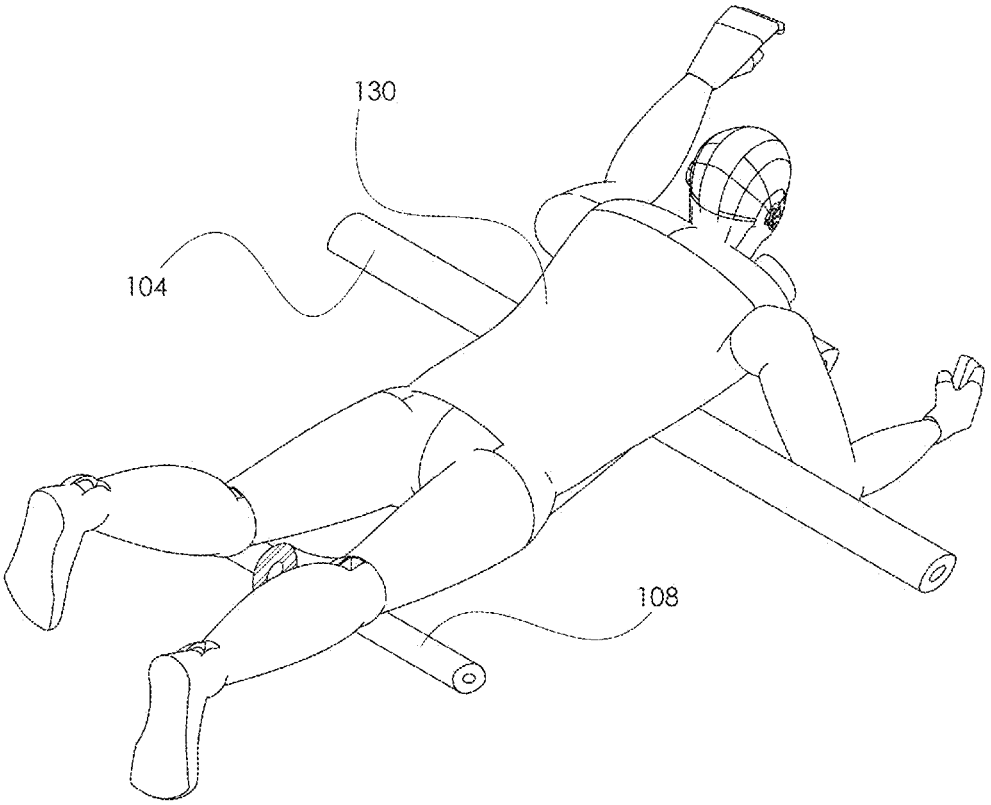
Figure 5C:
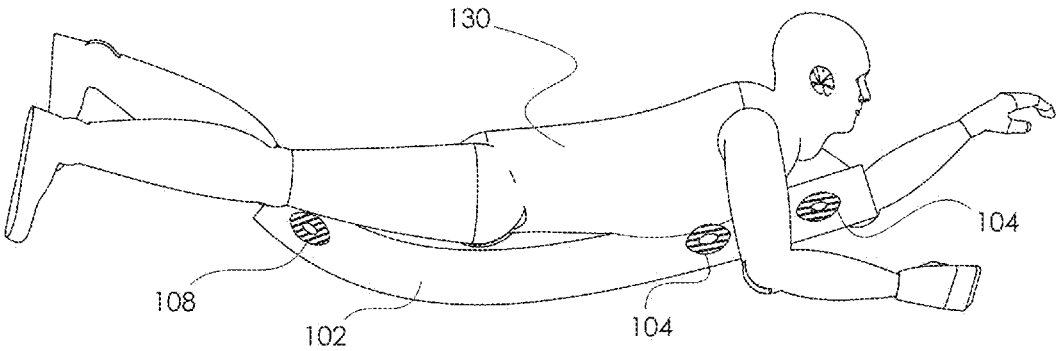

FIGS. 5A-5C depict user 130 using the apparatus 100 in a partially deformed state for swimming. Due to the weight and positioning of user 130, the main body member 102 is partially deformed. The partially deformed main body member 102, the primary support member 104 and the foot support member 108 in this position provide stability for remaining comfortably on the apparatus 100 while the user 130 is swimming.

Figure 6A:
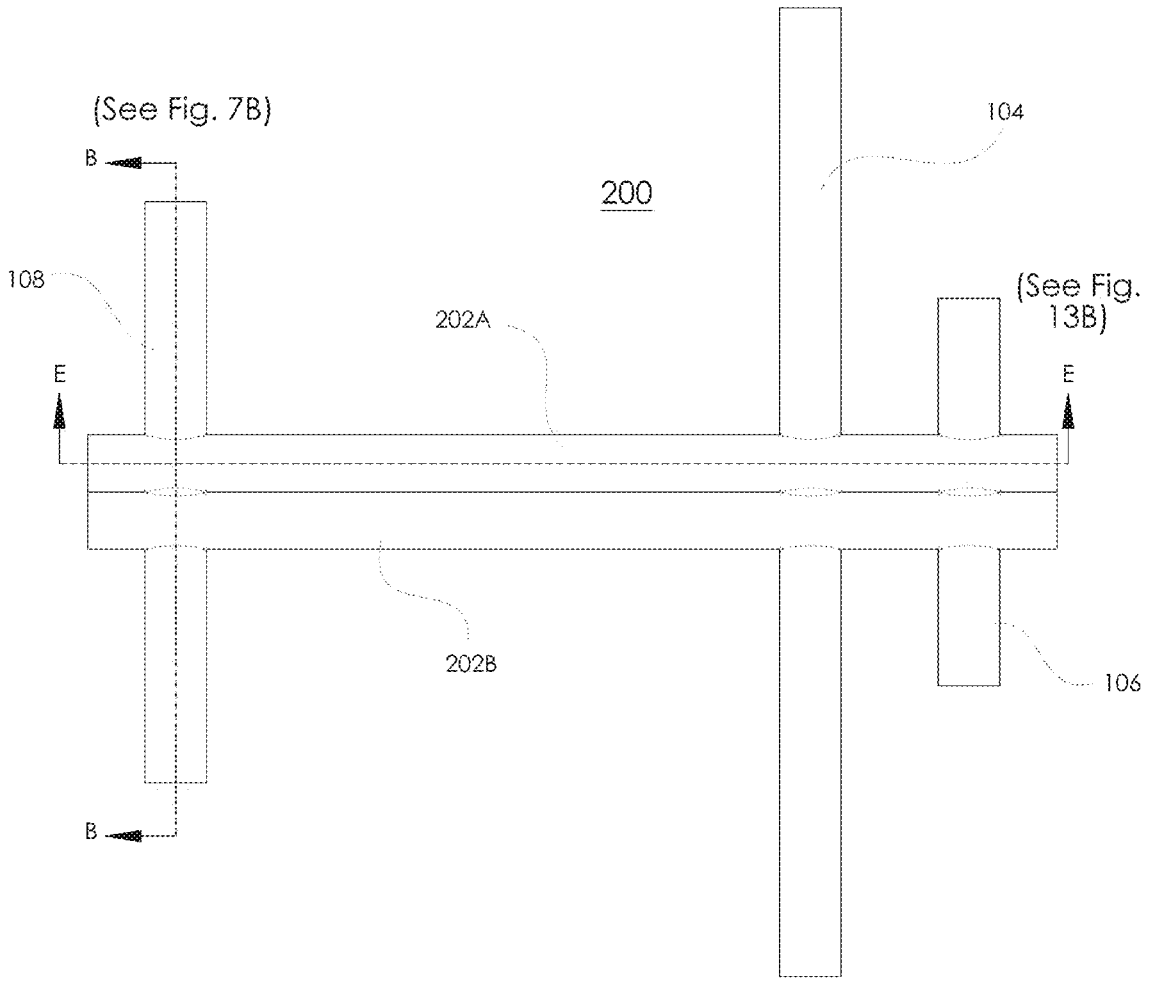
FIGS. 6A, 6B and 6C depict a top view, a perspective view, and a side view, respectively, of one embodiment of the personal flotation apparatus having a dual main body member.
Figure 6B:
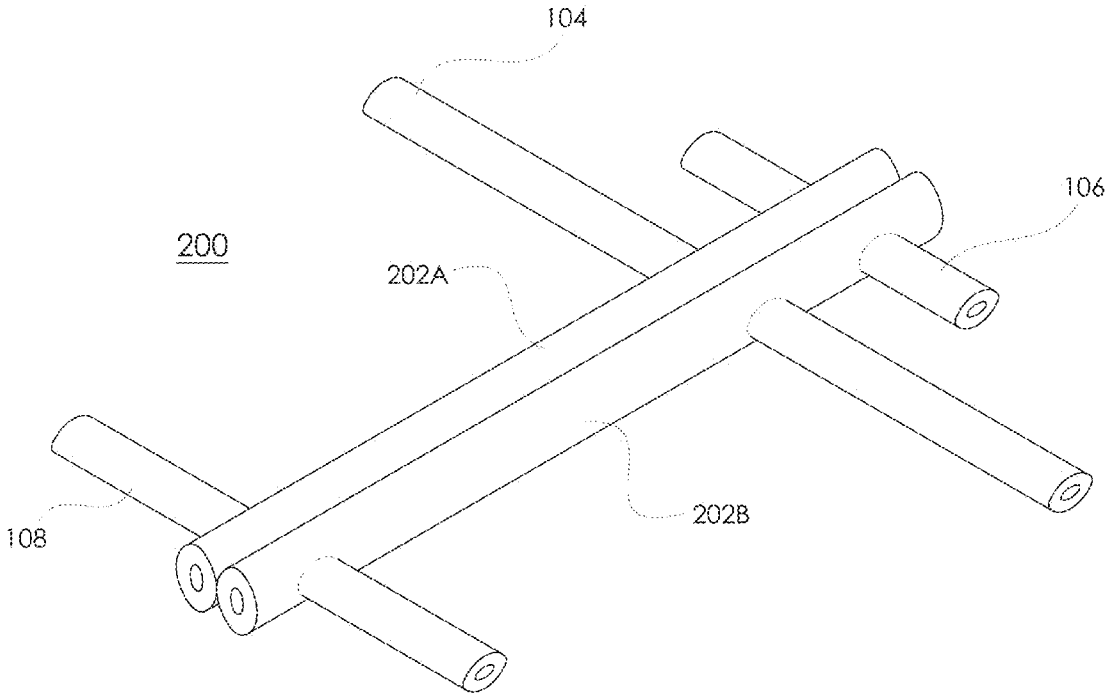
Figure 6C:
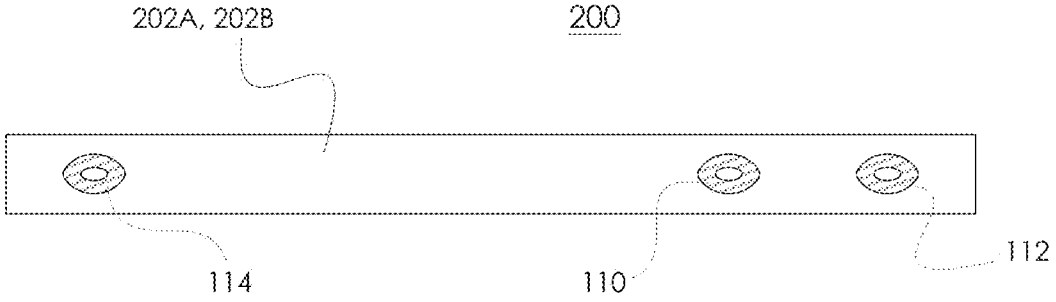

Another embodiment of the disclosed subject matter is depicted in FIGS. 6A-6C. An apparatus 200 generally comprises a first main body member 202A, a second main body member 202B, a primary support member 104, a head support member 106, and a foot support member 108. The use of two main body members 202A, 202B in this embodiment is to increase buoyancy, support and comfort, and among other advantages, may allow for heavier users. While this embodiment depicts two main body members 202A, 202B, other embodiments may include additional main body members. Still other embodiments may include more than one primary support member 104, head support member 106, and/or foot support member 108.

The primary support member 104, the head support member 106 and the foot support member 108, are each generally connected to the main body members 202A, 202B, such that the support members 104, 106, 108 are substantially perpendicular to the main body members 202A, 202B. For example, the primary support member 104, the head support member 106, and the foot support member 108 may be connected to the main body members 202A, 202B by a friction fit through a primary support hole 110, a head support hole 112, and a foot support hole 114, respectively, cut through each of the main body members 202A, 202B. While a friction fit is depicted in this embodiment to allow for disassembly and reassembly for ease of shipping, display and storage, other embodiments may use other permanent, nonpermanent, and/or adjustable means to connect the support members 104, 106, 108 to the main body members 202A, 202B.

The apparatus 100, 200 may be made of a flexible, buoyant flotation material, for example a closed cell foam material, or any other suitable material. The depicted embodiments show the members of the apparatus 100, 200 as elliptic cylinders due to the fact that the holes 110, 112, 114 can be cut on the major axis side of the ellipse of the main body members 102, 202A, 202B, with the minor axis of the ellipse of holes 110, 112, 114 parallel to the major axis of the main body members 102, 202A, 202B. The major axis of the ellipse of the main body members 102, 202A, 202B need only be slightly greater than the smallest diameter of the support members 104, 106, 108, which is cost-effective for manufacturing because it allows for reasonably-sized members using minimal material. Additionally, using elliptical cylinders in such a manner allows for more material to remain between the outer surface edge of the main body member 102 and the inner surface of the holes 110, 112, 114, making tears through the main body member 102 less likely. For example, the support members 104, 106, 108 may have an elliptic major axis of approximately 3.5 inches and elliptic minor axis of approximately 2.2 inches, and the main body member 102 may have an elliptic major axis of approximately 4.5 inches and an elliptic minor axis of approximately 3.3 inches, however other dimensions may be used. To achieve a friction fit using the same example dimensions for support members 104, 106, 108, example dimensions for holes 110, 112, 114 may include an elliptic major axis of approximately 3.3 inches and an elliptic minor axis of approximately 2.1 inches, however other dimensions may be used. Different embodiments of the disclosed subject matter may use shapes other than elliptic cylinders for any and all of the members of apparatus 100, 200, such as circular cylinders or rectangular prisms, for example. Similarly, while the holes 110, 112, 114 are shown as ellipses for the above stated reason, other embodiments may use different shapes for the holes 110, 112, 114.

Figure 7A:
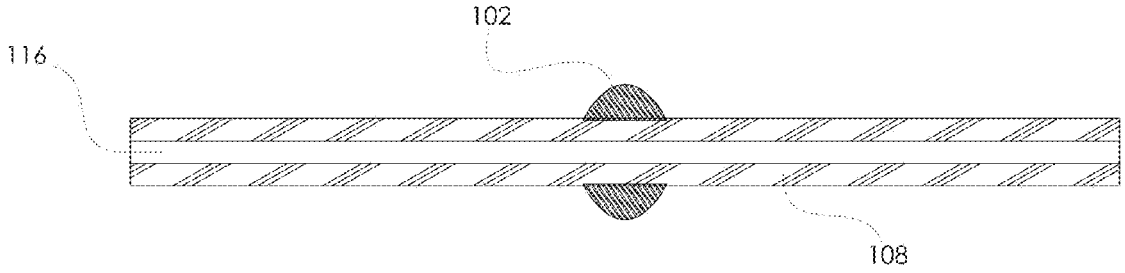
FIG. 7A depicts a cross-sectional view taken along the line A-A of FIG. 1A.
Figure 7B:
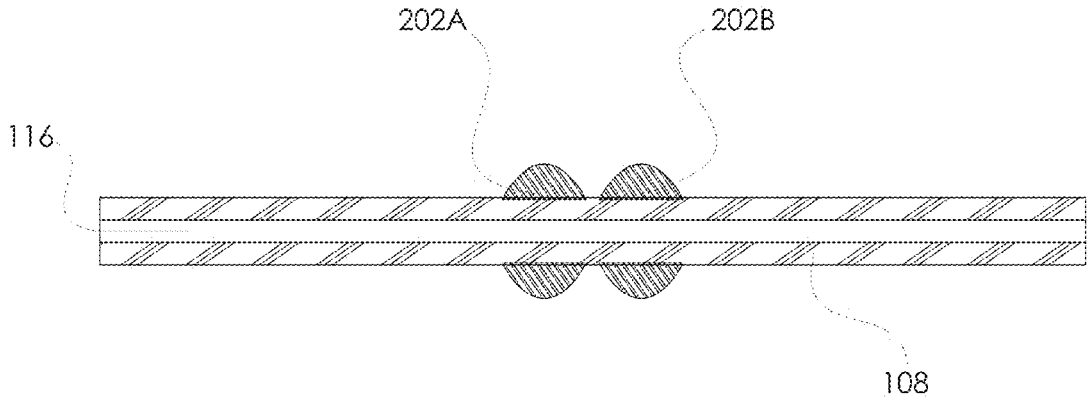
FIG. 7B depicts a cross-sectional view taken along the line B-B of FIG. 6A.

FIG. 7A depicts a cross-sectional view taken along line A-A in FIG. 1A, and FIG. 7B depicts a cross-sectional view taken along line B-B in FIG. 6A. While these embodiments show the members of the apparatus 100, 200 having a hollowed center 116 for purposes of decreasing required material without affecting buoyancy, in some embodiments one or more of the members of apparatus 100, 200, may not include the hollowed center 116, and in other embodiments the hollowed center 116 of one or more of the members of apparatus 100, 200 may be smaller, bigger, or in a different shape.

In some embodiments, multiple members are combined to build larger flotation devices.

Figure 8A:
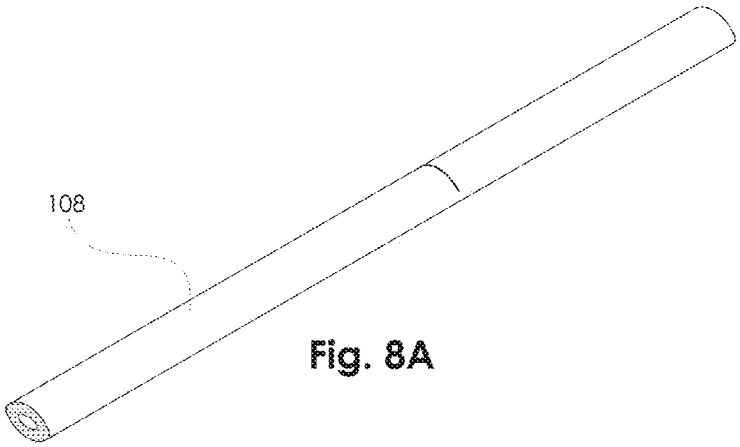
FIGS. 8A, 8B and 8C depict a perspective view, a side view, and a cross-sectional view, respectively, of a supporting main body member of an embodiment of the personal flotation apparatus.
Figure 8B:
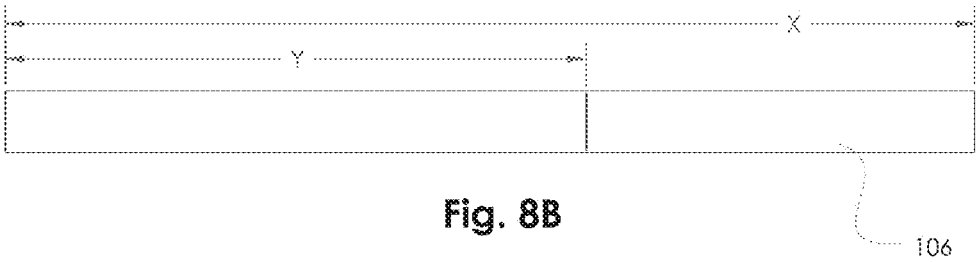
Figure 8C:
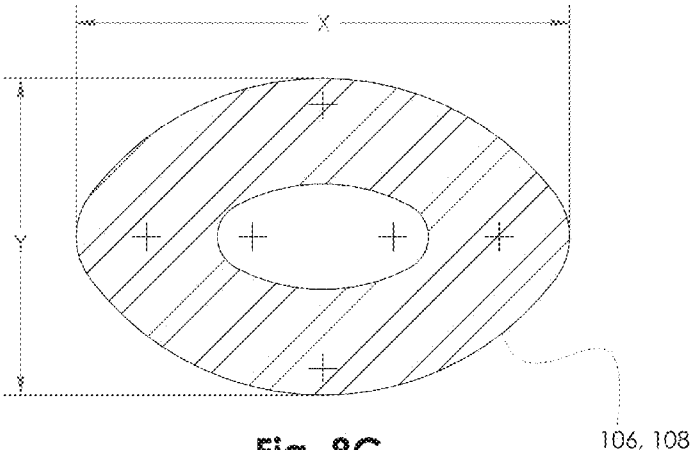

FIGS. 8A, 8B, and 8C depict an exemplary cross member in an isometric view, side-on perspective, and end cross section view. FIG. 8C shows exemplary dimensions of an elliptical cross section with the relative ratio of major axis 300 to minor axis 302 being in the order of 3 to 2. Furthermore, the relative ratio of cross sectional area versus internal void may be in the order of 4 to 1.

Figure 9A:
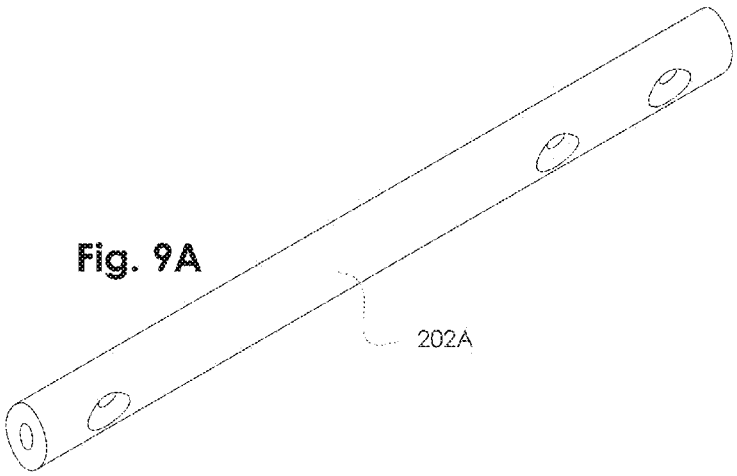
FIGS. 9A, 9B and 9C depict a perspective view, a side view, and a cross-sectional view, respectively, of a main body member of an embodiment of the personal flotation apparatus.
Figure 9B:
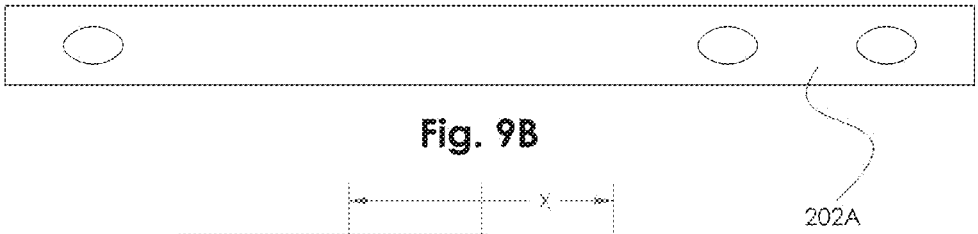
Figure 9C:
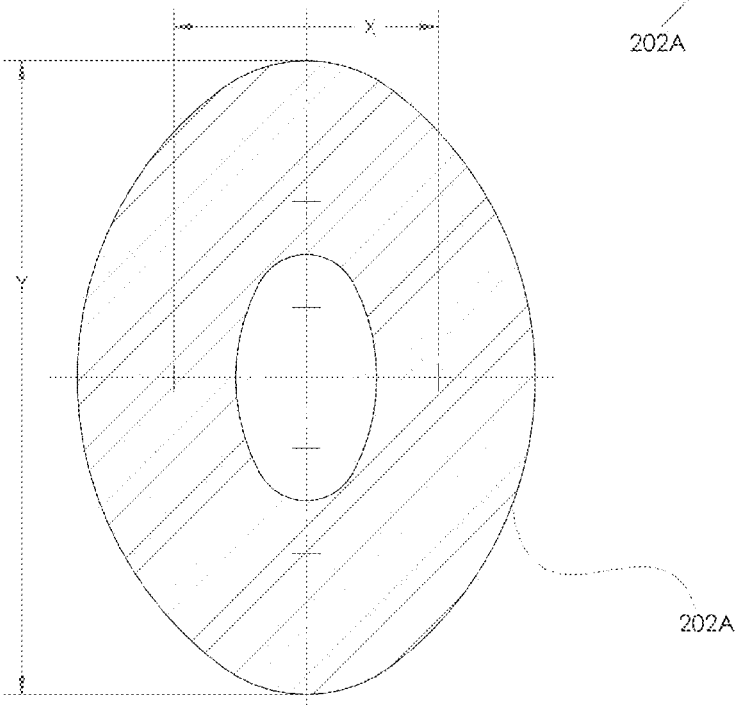

FIGS. 9A, 9B, and 9C depict an exemplary main member 102 in an isometric view, side-on perspective, and end cross section view. FIG. 9C shows exemplary dimensions of an elliptical cross section with the relative ratio of major axis 304 to minor axis 306 being in the order of 4 to 3. Furthermore, the relative ratio of cross sectional area 308 versus internal void 310 may be in the order of 5 to 1.

Figure 10A:
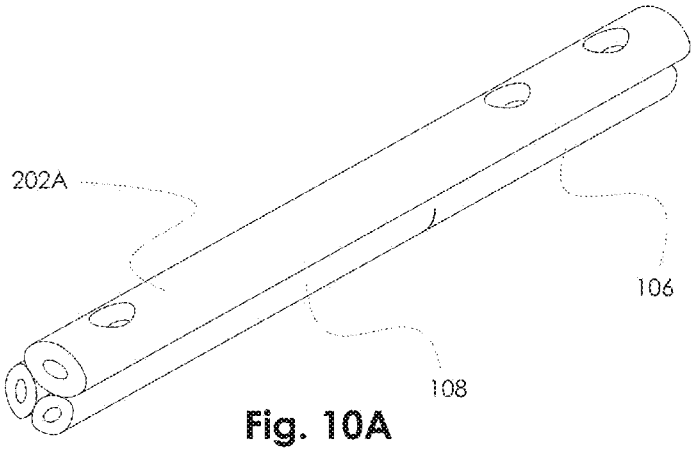
FIGS. 10A, 10B and 10C depict a perspective view, a side view, and a cross-sectional view, respectively, of a triple main body member of one embodiment of the personal flotation apparatus having a triple main body member.
Figure 10B:
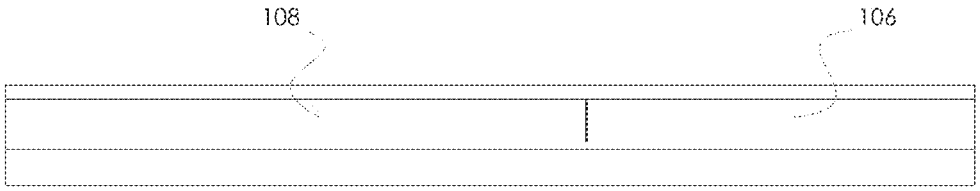
Figure 10C:
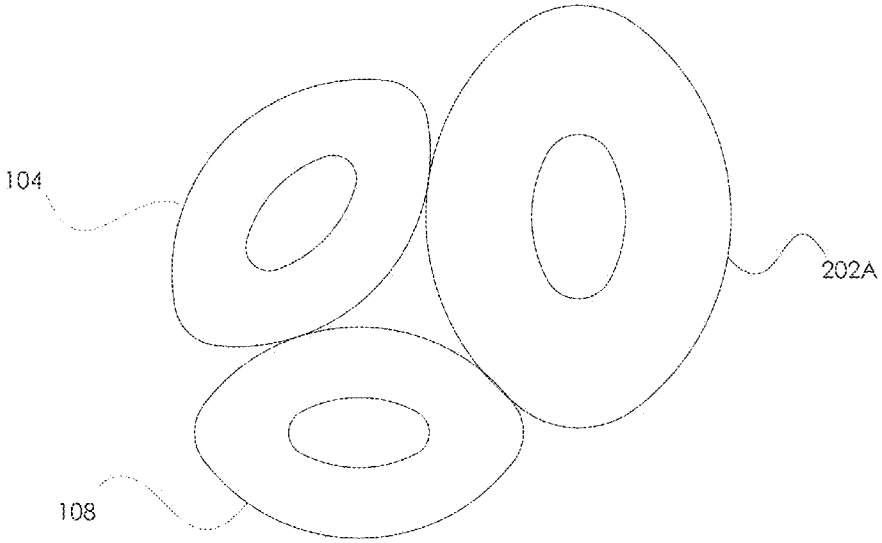

FIGS. 10A, 10B and 10C depict an exemplary packaged embodiment depict an exemplary cross member 104 and 106 and exemplary main member 102 in an isometric view, side-on perspective, and end cross section view. As shown, at least one member may have a proportionally larger cross section. One member may also include elliptical shaped cross sectional orifices 110, 112, or 114. One member may also include perforations for tearing, or separating, into two component parts.

For contrast purposes, FIG. 11A depicts a cross member, 104, 106, or 108 with elliptical shaped cross section with the elliptical major axis aligned horizontal, and FIG. 11B depicts a main member with elliptical shaped cross section with the elliptical major axis aligned vertical. The use of main member 102 with elliptical shaped cross section with the elliptical major axis aligned vertical in some embodiments may be advantageous for providing increased stiffness when compared to embodiments having circular cross-section. Furthermore, the increased stiffness may reduce deflection, and therefore improve usability.

The use of cross member with elliptical shaped cross section with the elliptical major axis aligned horizontal in some embodiments may be advantageous by providing increased surface area relative to mass and therefore increased buoyancy of the overall apparatus.

FIG. 11C depicts an exemplary cross member in viewed top down, and FIG. 11D depicts an exemplary main member viewed top down. As shown, the main member detailed in FIG. 11D may have slight indention as a result of the orifice positioned along the length.

FIG. 11E depicts an end-on perspective of a cross member with exemplary dimensions. Exemplary dimensions are shown for the purposes of detailing the relative ratio of width versus height.

FIG. 11F depicts an exemplary interference fit between the main member and the cross sectional member. As shown, the orifice dimensions (for example only) both vertical and horizontal diameter are less than those shown for the cross member. As such, the insertion of the cross member into the orifice forms an interference fit. The dimensions of the orifice in comparison to the dimensions of the cross member are such that sufficient resistance force may be offered. In some embodiments, this may be accomplished by the provision of orifice that are for example of a diameter ⅛ inch smaller than the diameter of the cross member being inserted.

The use of cross-members with elliptical cross sections and corresponding elliptical cross-section orifice in the main member may be advantageous in providing increased cross section area 312 above and below the orifice. Embodiments design thus may be more durable, able to withstand greater loading, etc.

Figure 12A:
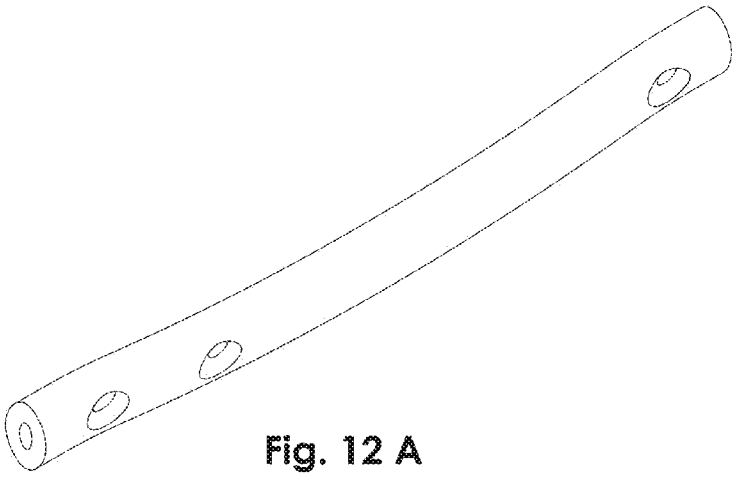
FIGS. 12A and 12C depict a perspective view and a side view, respectively, of a supporting main body member of an embodiment of the personal flotation apparatus in a partially deformed state.
Figure 12B:
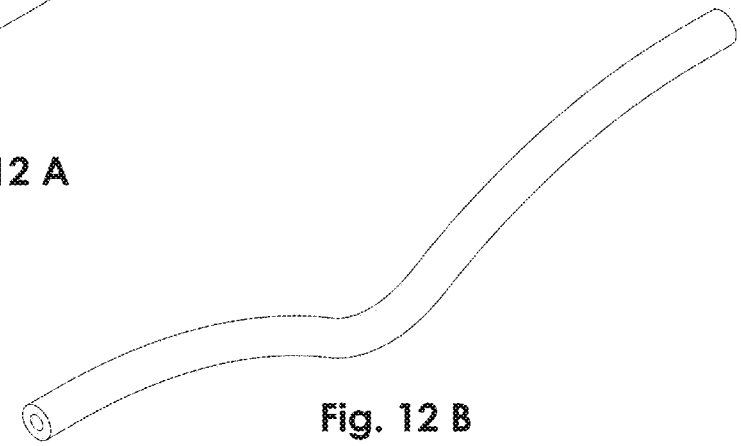
FIGS. 12B and 12D depict a perspective view and a side view, respectively, of a supporting main body member of an embodiment of the personal flotation apparatus in a partially deformed state.
Figure 12C:
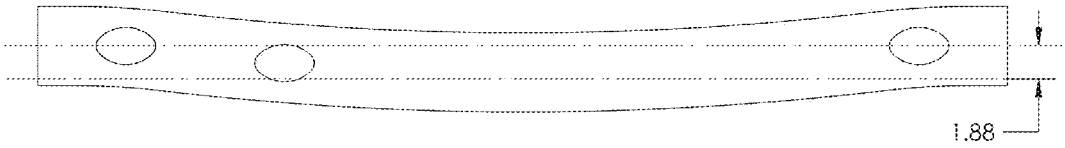
Figure 12D:
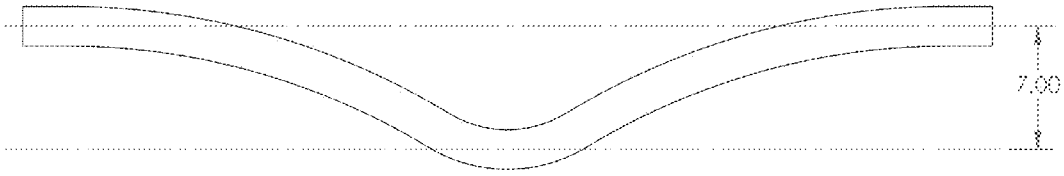

For comparison purposes, FIG. 12A depicts an elongated main member 102 having an elliptical cross section and three orifice 110, 112, and 114 and FIG. 12B depicts a (prior art) floatation device with circular cross section. The impacts of applying loading to the respective members are shown in FIG. 12C, wherein the member having elliptical cross section deflects of a magnitude less than the member having circular cross section, see FIG. 12D for the same loading conditions.

In some embodiments, the apparatus may be configured, at least initially as components all of equal length. These components may be configurable so as to be capable of being packaged in a vertical orientation.

In some embodiments, see FIGS. 8A and 8B a member may be perforated to enable the member to be separated into two or more sub-component parts. This arrangement may allow the assembly of the resulting sub-components through the orifice of the main member.

An advantage of using perforated members includes the ease of packaging and transporting of the apparatus while maintaining functionality for the end user. This ability to separate the member into two or more parts in some embodiment grants the user flexibility in the use of the device. Some embodiments may allow the end-to-end reconnection of sub-component parts.

Further embodiments may be provided fully pre-cut into two or more sub-components. These embodiments may be initially removable coupled, such as through a shrink wrap cover. Other removable coupling as known in the art may be also be used. Further embodiments may allow for the removable connection to be reused.

Some embodiments may include an interference fit between the main member and the cross members so as to ensure appropriate level of friction between the two intersecting parts and affected surfaces that hold the parts together while in use in the water. Other arrangements of connecting floatation devices, such as those disclosed in the prior art that do not utilize an interference fit or other resistant applying connection are prone to failure due to water acting as a lubricant. Some embodiments of the present disclosure achieve an interference fit by making the one or more orifice dimensions slightly smaller than the outside dimensions of the cross member. This arrangement ensures appropriate friction to hold the water float together in the water.

Embodiments using this arrangement may be advantageous as may they may not need to incorporate a secondary material or component to form the connection.

Some embodiments of the present disclosure include elliptical shaped orifices wherein the orifice major axis is aligned horizontal or parallel to the water surface. Furthermore, in some embodiments the cross member major axis may also be aligned parallel to the surface of the water so to match the available orifice. An advantage of this arrangement over prior art examples providing an increased surface area for the cross members thereby increasing the buoyancy.

Figure 13A:
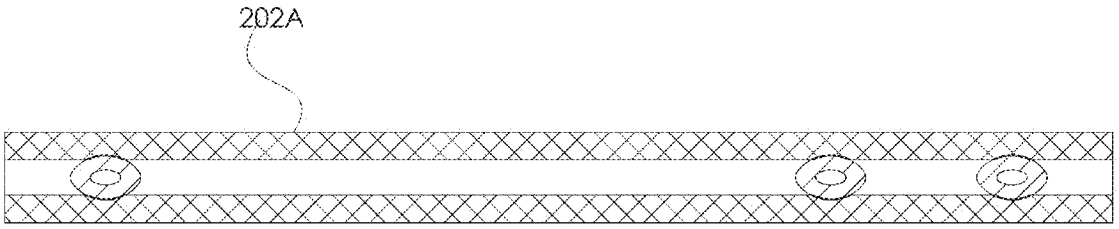
FIGS. 13A and 13B depict a side on perspective of an embodiment having the cross members with having elliptical cross sections.
Figure 13B:
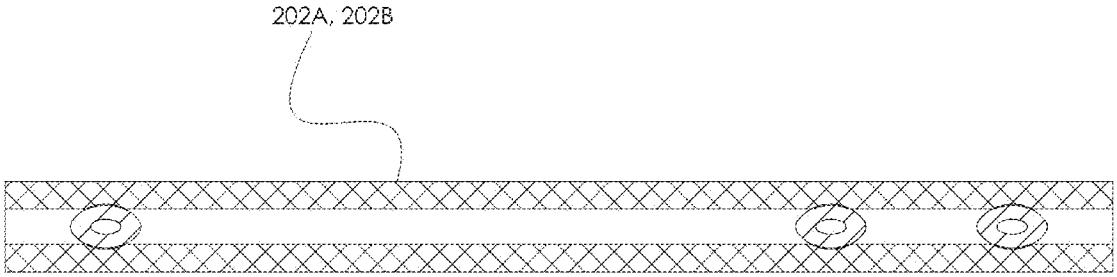

FIGS. 13A and 13B depict a side on perspective of an embodiment having the cross members with having elliptical cross sections. Furthermore, FIGS. 13A and 13B detail the additional area available above and below the orifice as a result of the cross-section. Furthermore, FIGS. 13A and 13B detail the additional diameter of the cross-member when compared to the diameter of the orifice.

Some embodiments of the apparatus may be constructed using high-density close-cell polyethylene foam. Embodiments using high-density polyethylene may be advantageous through reduction in deflection in comparison to standard industry flotation devices constructed of open-cell low density foam. Open-cell low density foam is also subject to saturation compared to high-density close-cell polyethylene foam which resists water absorption.

Some embodiments may include a UV additive in the material composition to increase life-span of the apparatus.

While the disclosed subject matter has been described with respect to a limited number of embodiments, the specific features of one embodiment should not be attributed to other embodiments of the disclosed subject matter. No single embodiment is representative of all aspects of the disclosed subject matter. Moreover, variations and modifications therefrom exist. For example, the disclosed subject matter described herein may comprise other components. Various additives may also be used to further enhance one or more properties. In some embodiments, the disclosed subject matter is substantially free of any additive not specifically enumerated herein. Some embodiments of the disclosed subject matter described herein consist of or consist essentially of the enumerated components. In addition, some embodiments of the methods described herein consist of or consist essentially of the enumerated steps. The claims to be appended later intend to cover all such variations and modifications as falling within the scope of the disclosed subject matter.

The invention claimed is:

1. A flotation apparatus comprising:

an elongated main body member having a longitudinal axis, the main body member having an elliptical cross sectional shape, the main body member having a first hole therethrough, a second hole therethrough and a third hole therethrough, each of the first hole, second hole, and third hole extending perpendicular to the longitudinal axis, each of the first hole, second hole, and third hole having an elliptical cross section with a major axis parallel to the longitudinal axis of the main body member;

an elongated head support member having a longitudinal axis, the head support member having an elliptical cross sectional shape, the head support member extending substantially perpendicular to the main body member at an upper end of the main body member, the head support member extending through the first hole of the main body member to the extent that a first portion of the head support member is positioned on a first side of the main body member and to the extent that a second portion of the head support member is positioned on a second side of the main body member;

an elongated foot support member having a longitudinal axis, the foot support member having an elliptical cross sectional shape, the foot support member extending substantially perpendicular to the main body member at a lower end of the main body member and substantially parallel to the head support member, the foot support member extending through the second hole of the main body member to the extent that a first portion of the foot support member is positioned on the first side of the main body member and to the extent that a second portion of the foot support member is positioned on the second side of the main body member; and an elongated primary support member having a longitudinal axis perpendicular to the longitudinal axis, the primary support member having an elliptical cross sectional shape, the primary support member extending substantially perpendicular to the main body member positioned along the length of the main body member between the head support member and the foot support member and substantially parallel to the head support member, the primary support member extending through the third hole of the main body member to the extent that a first portion of the primary support member is positioned on the first side of the main body member and to the extent that a second portion of the primary support member is positioned on the second side of the main body member.

2. The flotation apparatus of claim 1, wherein the primary support member is spaced apart from the head support member to define a gap therebetween.

3. The flotation apparatus of claim 1, wherein the primary support member has a length greater than that of the head support member and that of the foot support member.

4. The flotation apparatus of claim 3, wherein the foot support member has a length greater than that of the head support member.

5. The flotation apparatus of claim 4, wherein the main body member comprises a length of approximately fifty five inches.

6. The flotation apparatus of claim 5, wherein the head support member is connected to the main body member at a location approximately fifty inches from the lower end thereof.

7. The flotation apparatus of claim 5, wherein the foot support member is connected to the main body member at a location approximately seven inches from the lower end thereof.

8. The floatation apparatus of claim 5, wherein the primary support member is connected to the main body member at a location approximately forty one inches from the lower end thereof.

9. The flotation apparatus of claim 4, wherein the length of the primary support member ranges from four feet to five feet.

10. The flotation apparatus of claim 4, wherein the length of the foot support member ranges from two feet to three feet.

11. The flotation apparatus of claim 4, wherein the length of the head support member ranges from one foot to two feet.

12. The flotation apparatus of claim 1, wherein the main body member comprises a generally cylindrical shape.

13. The flotation apparatus of claim 12, wherein the main body member comprises an elliptic cylinder shape having a major dimension longer than a minor dimension, and wherein the at least one orifice extends through the main body member perpendicular to the major dimension.

14. The flotation apparatus of claim 13, wherein at least one of the primary support member, the head support member, and the foot support member comprises an elliptic cylinder shape having a major dimension less than the major dimension of the main body member and a minor dimension less than the minor dimension of the main body member.

15. The flotation apparatus of claim 1, wherein the primary support member is deformable in a direction perpendicular to the main body member and perpendicular to the head support member and the foot support member.

16. The flotation apparatus of claim 1, wherein at least one of the main body member, the primary support member, the head support member, and the foot support member comprises an elliptic cylinder shape.

17. The flotation apparatus of claim 1, further comprising at least one additional main body member secured adjacent to and parallel to the main body member and comprising orifices formed therein for accommodating the head support member, the foot support member, and the primary support member.

18. The flotation apparatus of claim 1, wherein at least one of the main body member, the head support member, the foot support member, or the primary support member has a hollow central region.

* * * * *